US006666778B2

(12) United States Patent
Ashida

(10) Patent No.: US 6,666,778 B2
(45) **Date of Patent: *Dec. 23, 2003**

(54) FRP GOLF CLUB SHAFT

(75) Inventor: Hiroki Ashida, Gifu (JP)

(73) Assignee: Mizuno Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/990,664

(22) Filed: Nov. 21, 2001

(65) Prior Publication Data

US 2002/0103040 A1 Aug. 1, 2002

(30) Foreign Application Priority Data

Nov. 24, 2000 (JP) ..... 2000-357859

(51) Int. Cl.[7] ..... A63B 53/10
(52) U.S. Cl. ..... 473/319
(58) Field of Search ..... 473/316–323; 428/36.3, 36.9; 264/635; 156/187, 188

(56) References Cited

U.S. PATENT DOCUMENTS 3,998,458 A * 12/1976 Inoue et al. ..... 473/319
5,143,374 A * 9/1992 Shibasaki ..... 473/319
5,437,450 A * 8/1995 Akatsuka et al. ..... 473/320
5,633,074 A * 5/1997 Muroi et al. ..... 428/213
5,653,646 A * 8/1997 Negishi et al. ..... 473/319
5,700,533 A * 12/1997 You ..... 428/36.3
5,897,447 A * 4/1999 Nishihara ..... 473/535
6,270,426 B1 * 8/2001 Matsumoto ..... 473/319

FOREIGN PATENT DOCUMENTS

JP 11-342233 * 12/1999

* cited by examiner

*Primary Examiner*—Stephen Blau
(74) *Attorney, Agent, or Firm*—Troutman Sanders LLP; Gerald R. Boss

(57) ABSTRACT

A golf club shaft has a braid layer including first and second diagonal yarns. The diagonal yarns are positioned at the degrees of orientation (+θ, −θ) of +30° to +60° and −30° to −60° against the longitudinal axis 13 of the shaft, respectively. The braid layer has a portion that satisfies an inequality, $n\cdot\{(t-\sigma t)/\cos\theta\}\leqq\pi\cdot D\leqq n\cdot\{(t+\sigma t)/\cos\theta\}$, wherein t is the average width of the diagonal yarns, σt is the standard deviation of the width of the diagonal yarns, D is the shaft diameter, and n is the number of diagonal yarns. The braid layer satisfying the inequality minimizes spaces S between the diagonal yarns. With the shaft of the present invention, the ratio of the longitudinal modulus of the shaft during a swing to the longitudinal modulus of the shaft when the head speed is zero gradually increases along with the increase in the head speed, thus suppressing shaft's deformation caused by centrifugal force during a swing and facilitating swings of the club.

19 Claims, 7 Drawing Sheets

FRP GOLF CLUB SHAFT

This application claims the priority to Japanese Patent Application No. 2000-357859, filed on Nov. 24, 2000.

BACKGROUND OF THE INVENTION

The present invention relates to a golf club shaft made of fiber reinforced plastics (or an FRP golf club shaft), and in particular it relates to a FRP golf club shaft which facilitates a swing by increasing modulus of longitudinal elasticity with increases in head speed during the swing, and a golf club having such a shaft.

A club shaft made of fiber reinforced plastics (hereinafter referred to as an 'FRP golf club shaft') is advantageous over metal golf shafts in that it has lighter weight than metal ones, which makes it easier to accelerate a swing and increase the flying distance. Thus, the FRP golf club shaft is extensively employed.

The FRP golf club shaft is a shaft formed of reinforcing fibers impregnated with resin. Types of FRP shafts include a shaft fabricated in the sheet rolling process (S/R shaft), a shaft fabricated in the filament winding process (FW shaft), and a braided shaft. The S/R shaft is formed by winding unidirectional prepreg sheets made of reinforcing fibers over a mandrel. The FW shaft is formed by winding a fiber bundle (yarn) of reinforcing fibers around the mandrel while reciprocating them along the longitudinal axis of the mandrel. The braided shaft is formed by braiding a plurality of fiber bundles (yarn) of reinforcing fibers or tow prepregs (or yarn prepregs) while braiding them over the mandrel to the substantially entire length of the shaft. The braided shaft is superior in improved bending strength since no joint exists both in the longitudinal and circumferential directions of the shaft and braid yarns are intertwined.

For example, JP-A-6-278216 discloses a braided shaft. The braided shaft is formed by intertwining a plurality of diagonal yarns, which are positioned symmetrically at a certain orientation against the longitudinal shaft axis, and warps positioned at 0° against the longitudinal shaft axis. The diagonal yarns and warps are interwoven to form a triaxial braid layer, which improves the bending strength of the shaft.

JP-A-11-342233 also discloses a braided shaft that is formed by laminating a plurality of braid layers. When all the braid layers have the triaxial construction that has a plurality of diagonal yarns set symmetrically against the longitudinal axis and warps set at 0° against the longitudinal axis, the three types of yarn overlap with each other at some portions and do not overlap at the others. In other words, the height differs at these portions. Thus, the shear strength between the braid layers decreases, and the bending strength and torsional strength are weakened. Consequently, conventional braided shafts have triaxial construction in its outer braid layer and biaxial construction in its inner braid layers.

The conventional shafts address an improvement in bending strength by including triaxial braid layers having symmetrical diagonal yarns and warps. However, during a swing, centrifugal load on the shaft increases with increases in the head speed, thus affecting the shaft performance (i.e., bending deformation of the shaft and the corresponding change in feelings or flying distance). Therefore, the relationship between the load due to centrifugal force and deformation should be studied more in detail.

Consider the state of the shaft during a swing. The golfer causes generally rotational motion of the head of the club during a swing to hit a ball. It is assumed that (1) centrifugal force immediately before the impact and (2) inertial force caused by acceleration or deceleration of the head are applied to the shaft. More specifically, the centrifugal force of (1) is 300 to 500 N which is generated immediately before the impact, during which time the head speed reaches 40 to 50 m/s. This force pulls the entire shaft in the centrifugal direction of the rotational motion and causes bending deformation and tensile deformation in the shaft. The inertial force of (2) originates in acceleration or deceleration of the head when the golfer rotates, twists, or translates his waist, arms, or wrists. This force applies bending or torsional moment on the shaft, thus causing its bending or torsional moment. The centrifugal and inertial forces produce (A) tensile stress and compression stress symmetrical to the neutral plane that are caused by bending moment on the shaft that is applied in the direction of the shaft and (B) tensile stress in the longitudinal direction that is caused by centrifugal force.

The neutral plane of (A) means a virtual plane located along the longitudinal axis of the shaft upon which no tensile stress and compression stress act. The centrifugal force particularly acts on the shaft with significant force in the state before the impact, in which the club is swung down and the head speed has increased to some extent. In this state, the tensile deformation in the centrifugal direction and compression in the circumferential direction of (B) are negligibly small, while the bending moment of (A) increases with the acceleration of the head speed. In other words, as the centrifugal force on the shaft increases, the shaft deflects in a complicated fashion in combination with the change in the inertial force caused by the swing. Great increases in the bending moment change the deflection of the shaft greatly, which makes the degree of deformation unstable in the conventional shafts. This sometimes affects swings or feels (such as stability) perceived by golfers when they swing the golf clubs. Professional golfers, who have relatively high physical power and thus cause fast head speed and great deformation of the shaft or who have a more sensitive touch, are more likely to notice this shaft deformation. In particular, the shaft deformation immediately before the impact affects the trajectory of the balls hit. Therefore, it is important to suppress the shaft deformation and to stabilize the hit of the balls.

As shown in FIG. 10, in the shaft having a braid layer with the conventional triaxial construction, diagonal yarns 41 and 42 are symmetrically positioned at the degrees of orientation of $+\theta$ and $-\theta$ respectively against the warps 40 provided parallel to the longitudinal axis 43 of the shaft, and every other intersection of the diagonal yarns 41 and 42 exists on the warps 40. When the average width of the braid yarns 40, 41, and 42 is designated as t (mm) and the length perpendicular to the warps 40 at the intersection of the diagonal yarns 41 and 42 (or the length in the circumferential direction) is designated as $\iota$ (mm), the braid yarns are alternately positioned in the order t, $\iota$, t, $\iota$, and so forth. Since $\iota=t/\cos\theta$, the equation $t+\iota=t+t/\cos\theta$ is obtained. When the numbers of yarns are respectively set as n for the warps 40 and the diagonal yarns 41 and 42, sets of $t+\iota$ lined n times correspond to the entire circumference of the shaft. When the diameter of the shaft 2 is designated as D (mm), the circumference may be expressed as follows;

$$\pi D-n(t+t/\cos\theta)$$

In the conventional braid layers, since overlaps at a single point of three types of yarns 40, 41, 42 repeatedly exist, the height at the triaxial overlaps differs from that at other portions without the triaxial overlaps, thus increasing three-dimensional spaces S between the yarns. When the load on the shaft due to centrifugal force increases with acceleration of the head speed during a swing, the spaces S get smaller plastically, which increase deformation of the shaft.

BRIEF SUMMARY OF THE INVENTION

The object of the present invention is to provide a golf club shaft made of fiber reinforced plastic, which facilitates swing by suppressing deformation of the shaft by the centrifugal force applied to the shaft before the impact.

A golf club shaft made of fiber reinforced plastics has a braid layer along the length of the shaft that includes first diagonal yarns and second diagonal yarns. The first diagonal yarns have a first orientation angle against the longitudinal axis of the shaft. The second diagonal yarns have a second orientation angle, which is symmetrical with the first orientation angle, against the longitudinal axis of the shaft as the center axis. The ratio of the longitudinal modulus of the shaft during a swing to the longitudinal modulus of the shaft when the head speed is zero increases with the increase in the head speed.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
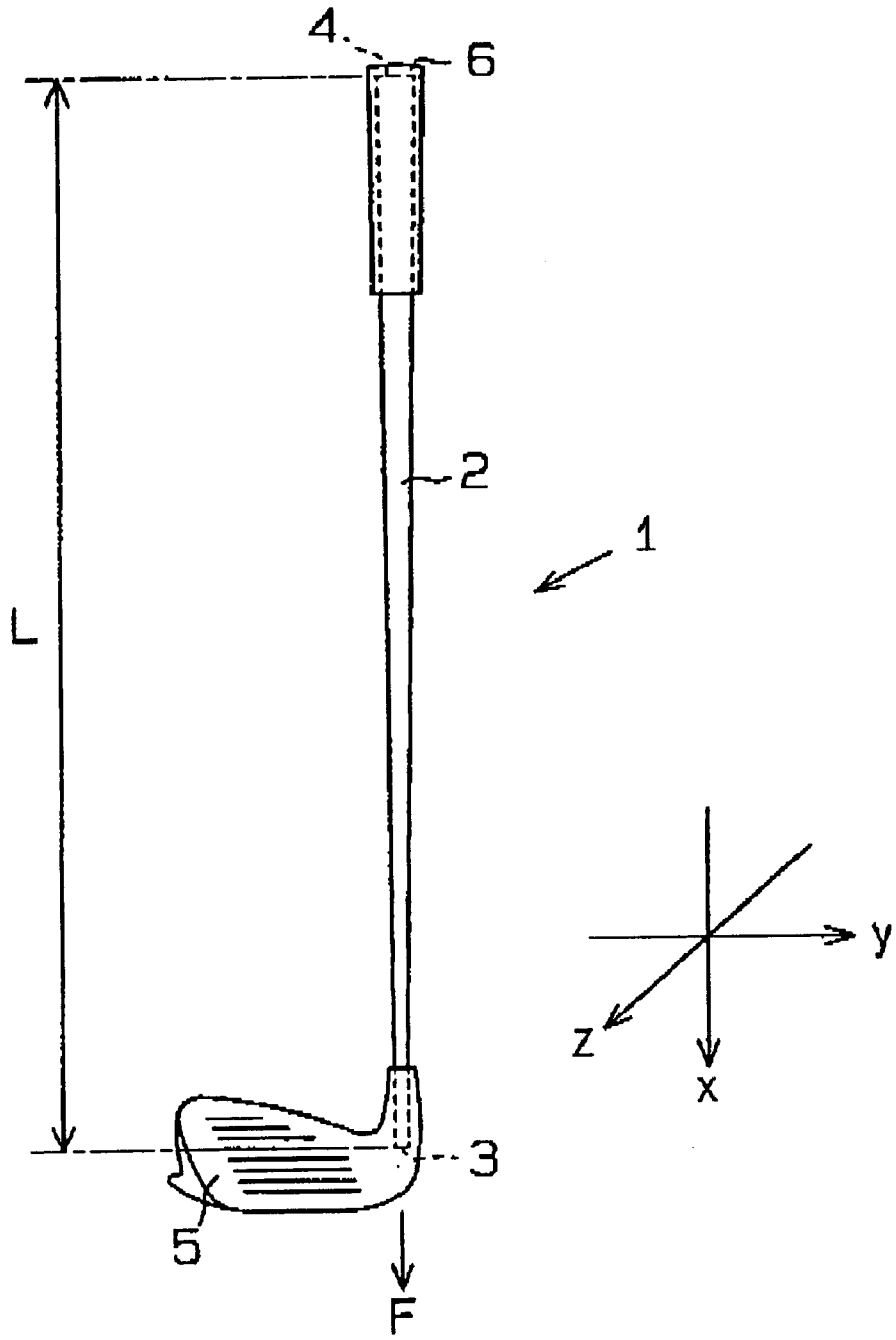
FIG. 1 is a perspective view of an FRP golf club having the shaft in accordance with an embodiment of the present invention.

The present invention is described by referring to the preferred embodiments shown in the attached drawings. FIG. 1 is a perspective view of an FRP golf club having the shaft in accordance with an embodiment of the present invention. A golf club 1 has a shaft 2 having a tip end 3 and butt end 4, a head 5 mounted on the tip end 3 of the shaft 2, and a grip 6 mounted on the butt end 4 of the shaft 2. The shaft 2 is generally tapered with its diameter decreasing from the butt end 4 toward the tip end 3.

The shaft 2 is formed of reinforcing fibers impregnated with resin matrix. The resin matrix includes thermosetting resin (e.g., epoxy resin, polyester resin and phenol resin) and thermoplastic resin (e.g., polypropylene resin, polyether-ether ketone resin, ABS resin and nylon resin). Epoxy resin is particularly preferred. The reinforcing fibers include carbon fiber, polyamide fiber, glass fiber, boron fiber, alumina fiber, aramid fiber, Tyranno™ fiber, and amorphous fiber. Carbon fiber is particularly preferred.

One of the required characteristics of the shaft 2 is the suitable rigidity for respective golfers. Excessively great rigidity will prevent a golfer from adding head speed by taking advantages of the deflection of the shaft 2, while insufficient rigidity leads to excessive flexibility of the shaft 2, which results in loss of ball control. It would be ideal that the quantity of deformation when load is applied to the shaft 2 is decreased, and thus the swing of the golf club 1 is facilitated by slightly increasing the rigidity of the shaft 2 at the top-of-swing or release of the cock.

Therefore, the present invention gives attention to the longitudinal modulus E of the shaft when tensile load corresponding to the centrifugal force (hereinafter referred to as the centrifugal force F) and Poisson's ratio $\nu$ at a certain location in the longitudinal direction of the shaft 2 so as to use them as an index for objectively evaluating the degree of deformation of the shaft 2.

The longitudinal modulus E is now described. In the course of a swing, the speed V of the head 5 increases from top-of-swing to the impact. As the head speed V increases, the centrifugal force F applied to the head also increases. The longitudinal modulus E is expressed by the equation $E=(F/A)\epsilon x$, wherein $\epsilon x$ is the tensile strain (or longitudinal strain) at a given position of the shaft, A is the cross sectional area, and F is the tensile load (or centrifugal force). With the shaft in accordance with the present invention, the longitudinal strain $\epsilon x$ does not vary as much as in the conventional shaft with the increase in the centrifugal force F. The longitudinal modulus E increases gradually with increased head speed V and centrifugal force F. Since the longitudinal modulus E is an index of the rigidity (or flexural rigidity) of the shaft, the rigidity of the golf club having the shaft of the present invention gradually increases during a swing up to the impact. Therefore, the shaft deviate less from the swing plane during a swing, in particular, just before the impact. The swing of the club having such shaft is thus facilitated by improving the longitudinal modulus E. The construction of the braided shaft having such longitudinal modulus E was studied.

Figure 2:
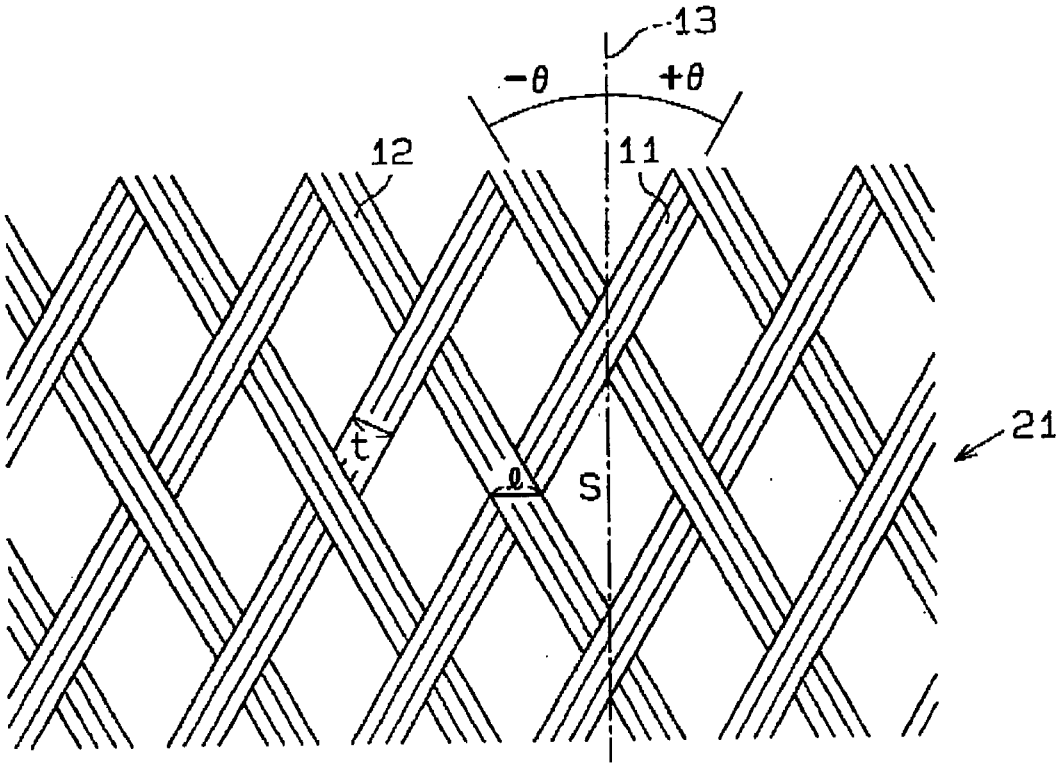
FIG. 2 is a partially enlarged view showing a part of an embodiment of biaxial braid layer of a preferred shaft in accordance with the present invention.
Figure 3:
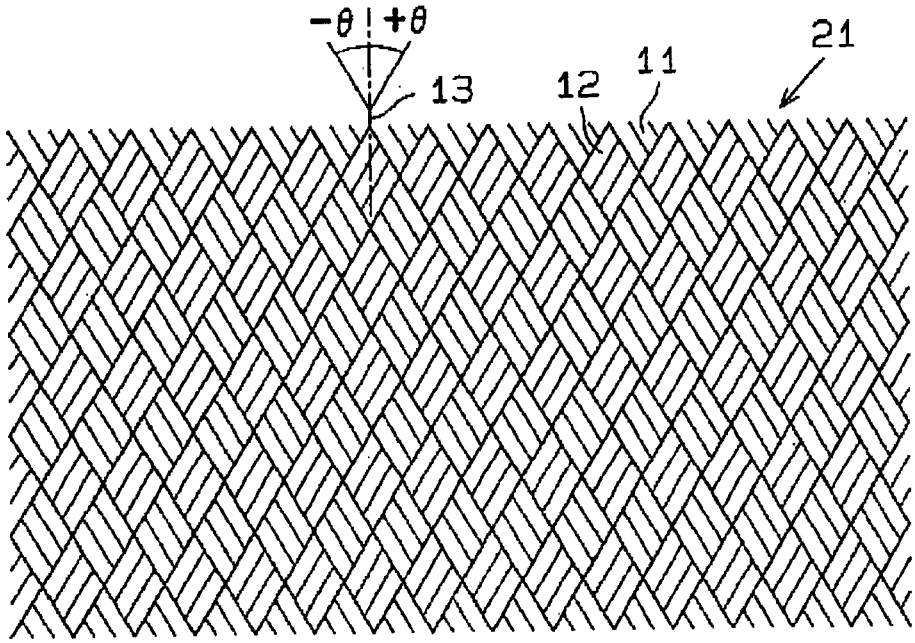
FIG. 3 is a partially enlarged view showing a part of an embodiment of biaxial braid layer of the most preferred shaft in accordance with the present invention in which gaps between the yarns are further narrowed from the braid layer of FIG. 2.
Figure 4:
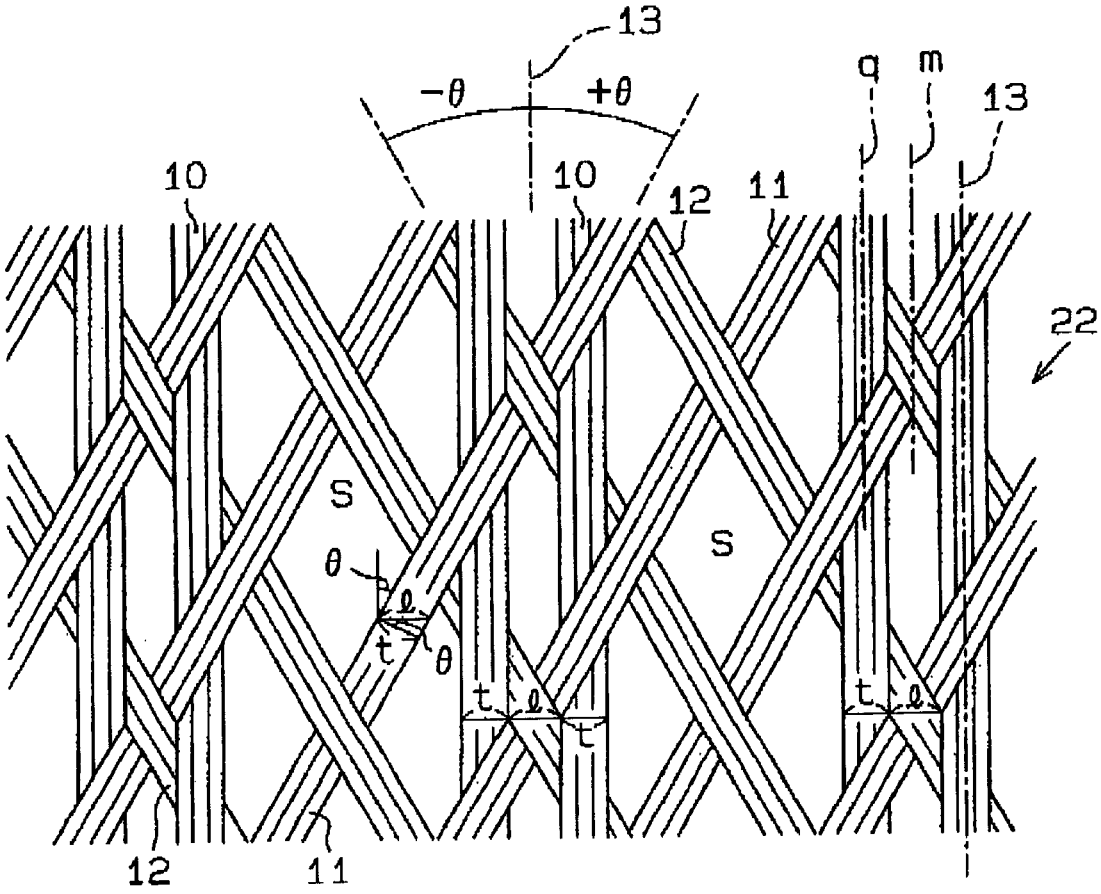
FIG. 4 is a partially enlarged view showing a part of an embodiment of triaxial braid layer of a preferred shaft in accordance with the present invention.

FIGS. 2 through 4 are partially enlarged views showing a part of a preferred embodiment of braid layers of a shaft in accordance with the present invention. A braid layer 21 in FIG. 2 is formed by intertwining first and second yarns 11 and 12, which are positioned at the degrees of orientation of +θ and −θ respectively against the longitudinal axis 13 of the shaft and substantially symmetrical. A braid layer 22 in FIG. 4 is formed by intertwining first and second diagonal yarns 11 and 12, which are angled against the longitudinal axis 13 of the shaft, and warps 10, which are positioned generally parallel to the longitudinal axis 13 of the shaft and at the orientation angle of approximately 0° against the longitudinal axis 13 of the shaft. The first and second diagonal yarns 11 and 12 and warps 10 are made of tow prepregs that are reinforcing fibers impregnated with resin, and are braided around a cylindrical mandrel to form the braid layers 21 and 22.

In the braid layer 21 comprising two types of yarns 11 and 12, the first and second degrees of orientation +θ and −θ of the first and second diagonal yarns 11 and 12 against the longitudinal axis 13 of the shaft preferably range from +30 to +60° and −30 to −60°, respectively, and more preferably from +35 to +55° and −35 to −55°, respectively. The diagonal yarns 11 and 12 intersect with each other in a pattern such that they pass above, below, above, below, and so forth relative to other yarns.

Spaces S created between the yarns 11 and 12 are preferably minimized. As shown in FIG. 3, the most preferable embodiment of the biaxial braid layer 21 has the spaces between yarns further narrowed from the braid layer 21 in the embodiment of FIG. 2, and has the diagonal yarns 11 and 12 alternately positioned with nearly no gaps. Then the equation $\iota = t/\cos\theta$ is obtained, where the t (mm) is the average width of the first and second diagonal yarns, and ι (mm) is the length perpendicular to the longitudinal axis 13 of the shaft at the intersection of the diagonal yarns 11 and 12 (or the length in the shaft circumferential direction). When the numbers of the diagonal yarns are respectively n (n=2, 4, 8, 16 . . . $2^k$, where k is a positive integer), ι's lined n times correspond to the entire circumference of the shaft. When the diameter of the shaft 2 is designated as D (mm), the circumference may be expressed as follows:

$$\pi D = n\iota = n \cdot t/\cos\theta \quad (1)$$

The diameter D is within the range of $3.0 \leqq D \leqq 16.0$.

The shaft that satisfies the equation (1) has minimum gaps S. Flexural rigidity of such shaft is improved as the centrifugal force applied to the shaft increases, thus deformation due to the centrifugal force is suppressed.

Since there are errors in braiding of actual shafts during the manufacturing process, the biaxial braid layer 21 has a portion that satisfies an inequality below:

$$n \cdot \{(t-\sigma t)/\cos\theta\} \leqq \pi \cdot D \leqq n \cdot \{(t+\sigma t)/\cos\theta\} \quad (2)$$

where σt is the standard deviation. In this embodiment, t is 1.6 to 2.4 mm, and σt/t is approximately 20%.

In the braid layer 22 comprising three types of braid yarns 10, 11 and 12, the first and second degrees of orientation +θ and −θ of the first and second diagonal yarns 11 and 12 against the longitudinal axis 13 of the shaft preferably range from +15 to +40° and −15 to −40°, respectively, and more preferably from +15 to +35° and −15 to −35°, respectively. The first diagonal yarn 11 intersects with the warps 10 and the second diagonal yarns 12 in a pattern such that the first diagonal yarn 11 passes above, above, below, above, above, below, and so forth with relative to the warps 10 and the second diagonal yarns 12 from the top to the bottom of the figure. The second diagonal yarn 12 intersects with the warps 10 and the first diagonal yarns 11 in a pattern such that the second diagonal yarn 12 passes above, above, below, above, above, below, and so forth with relative to the warps 10 and first diagonal yarns 11 from the top to the bottom of the figure.

The degrees of orientation of the first and second diagonal yarns 11 and 12 are identical, while a pair of diagonal yarns 11 and 12 asymmetrically intersects with a single warp 10. More specifically, a line m extending from the center of the intersection between the first and second diagonal yarns 11 and 12 and in parallel to the longitudinal axis 13 deviates from the centerline q of the warp 10 extending in the longitudinal direction of the warp 10. Since all the braid yarns are prevented from overlapping at a single point in the braid layer 22, or all the braid yarns only overlap single or double in the braid layer 22, gaps S generated in braiding yarns may be minimized.

The average width of the warps 10 and the first and second braid yarns 11 and 12 is designated as t (mm), the length perpendicular to the longitudinal axis 13 of the shaft at the intersection of the diagonal yarns 11 and 12 (or the length in the circumferential direction) is designated as ι (mm), the number of the warps 10 is n, and the numbers of the first and second diagonal yarns 11 and 12 are also respectively n (n=2, 4, 8, 16 . . . $2^k$, where k is a positive integer). Since sets of t+ι's lined n times correspond to the entire circumference of the shaft, the circumference may be expressed as follows when the diameter D (mm) ($3.0 \leqq D \leqq 16.0$) of the shaft 2 is designated as D (mm):

$$\pi D = n(t + t/\cos\theta) \quad (3)$$

However, the triaxial braid layer 22 generally has a portion that satisfies:

$$n \cdot (t + t/\cos\theta) < \pi \cdot D \leqq 2n \cdot (t + t/\cos\theta) \quad (4)$$

In this embodiment, t=1.6 to 2.4 (mm). Since there are errors in braiding of actual shafts during the manufacturing process, the average width t takes the range of t−σt to t+σt, where the standard deviation of the width of the warps and first and second diagonal yarns is σt. In this embodiment, σt/t is approximately 20%.

The shaft that satisfies the equation (4) has minimum three-dimensional gaps S. Rigidity of the shaft is improved as the centrifugal force applied to the shaft increases, thus deformation due to the centrifugal force is suppressed.

The shaft of the present invention may include the braid layer 21 and 22 shown in FIGS. 2 and 4, either alone or in combination.

The braid layers 21 and 22 extend the entire length of the shaft 2 in its circumferential direction and also extend the substantially entire length of the shaft 2 in the longitudinal direction so as to suppress deformation due to centrifugal force effectively. The portions of the braid layers 21 and 22 which satisfy the equations (2) and (4) may be a part of the entire length of the shaft; more specifically and preferably, the portion of the braid layer 21 satisfying the equations (2) is located for approximately one third of the entire length of the shaft from the tip end 3, while the portion of the braid layer 22 satisfying the equations (4) is located for approximately two third of the entire length of the shaft from the butt end 4.

In the shaft including a laminate of a plurality of braid layers, the braid layers 21 and 22 are positioned at any given position in the radial direction of the shaft. However, the biaxial braid layer 21 is preferably provided as an inner layer, and the triaxial braid layer 22 is preferably provided as an outer layer. In particular, although the braid layer 22 may be at least one layer, the braid layer is preferably a plurality of layers. The thickness of the braid layers in the radial direction of the shaft is preferably two third or more of the total thickness of the shaft, and more preferably three fourth or more.

In the shaft including an inner layer or the braid layer 21 and an outer layer or the braid layer 22, it is preferred that the longitudinal modulus E of the braid layer 21 is greater than the longitudinal modulus E of the braid layer 22 and that the thickness of the braid layer 21 is greater than a half of the entire thickness of the shaft. Since a plurality of braid yarns are interwoven in such a braided shaft, the braided shaft is superior in bending strength, twist and flexural rigidity and tensile strength. It is also favorable in terms of appearance, with fewer irregularities on the surface of the braid layers.

The Poisson's ratio $\nu$, which is the other index for evaluating the degree of deformation of the shaft 2, is now described. For the shaft whose longitudinal modulus E is increased with acceleration of the head speed V during a swing, deformation of the shaft is supposed to be effectively suppressed when the shaft has a Poisson's ratio $\nu$ of from 0.3 to 0.5.

The Poisson's ratio $\nu$ described herein is a ratio between the longitudinal strain $\epsilon x$, which is the quantity of longitudinal deformation, and the lateral strain $\epsilon yz$, which is the quantity of circumferential deformation, when the centrifugal force F is applied to an object (or the shaft herein) in the longitudinal direction. The Poisson's ratio $\nu$ may be expressed with the equation, $\nu=\epsilon yz/\epsilon x$. The Poisson's ratio is a unique value determined by the material and structure of the shaft.

Our investigation on the Poisson's ratio $\nu$ of various golf club shafts showed that conventional metal shafts have a relatively low Poisson's ratio $\nu$ of approximately 0.3 but that FRP shafts have Poisson's ratios $\nu$ of 0.6 to 0.8, which is twice or more that of the metal shafts. Therefore, FRP shafts deform more than metal shafts due to centrifugal force. In other words, more collapse or flattening of the shaft's cross section occurs in FRP shafts than in metal shafts due to bending moment. This probably affects the swing or feel of the club perceived by golfers.

Professional golfers, who have used metal shafts to improve their swings, tend to avoid a club with FRP shafts, since FRP shafts have significantly different performance and feeling from golf clubs with metal shafts. One of the reasons lies in misfit feelings originating from deformation of the FRP shafts. A research was conducted on a club shaft having feelings preferred by professional golfers and revealed that such a club shaft has the Poisson's ratio $\nu$ of 0.5 or less on at least a portion, in the longitudinal direction of the shaft. More preferably the Poisson's ratio $\nu$ of 0.5 or less at a portion on a grip side. Therefore, FRP shafts with the Poisson's ratio $\nu$ as low as metal shafts may be expected to be lightweight shafts with less deformation and with excellent club feelings during a swing.

The Poisson's ratio $\nu$ of the shaft in accordance with the present invention is preferred to be 0.5 or less in at least a portion of the shaft. The portion with Poisson's ratio $\nu$ is 0.5 or less may be positioned at any given location on the longitudinal direction of the shaft, and may extend along either a part of or the entire length of the shaft, although it is preferably on the grip side where great bending moment is applied during a swing. The deformation of the shaft may be more effectively suppressed by decreasing the Poisson's ratio $\nu$ in the shaft on the grip side, thus enhancing maneuverability of the shaft by golfers. In a preferred embodiment, the portion with the Poisson's ratio $\nu$ of 0.5 or less includes the part extending for one third of the shaft length from the shaft butt end 4 on the grip side. In another embodiment, the external diameter of the portion with the Poisson's ratio $\nu$ of 0.5 or less is larger than a half of the sum of the external diameter of the shaft tip end 3 and that of the shaft butt end 4.

While the Poisson's ratio $\nu$ of 0.5 or less is effective to prevent collapse or flattening of the shaft contour, the Poisson's ratio $\nu$ is preferable 0.3 or more. Actually, when a golf club shaft with the Poisson's ratio $\nu$ less than 0.3 was designed and manufactured, the shaft did not a minimum rigidity, strength, and performance as a golf club shaft. Accordingly, the Poisson's ratio $\nu$ ranging from 0.3 or more to 0.5 or less is preferred.

EXAMPLES

Figure 5:
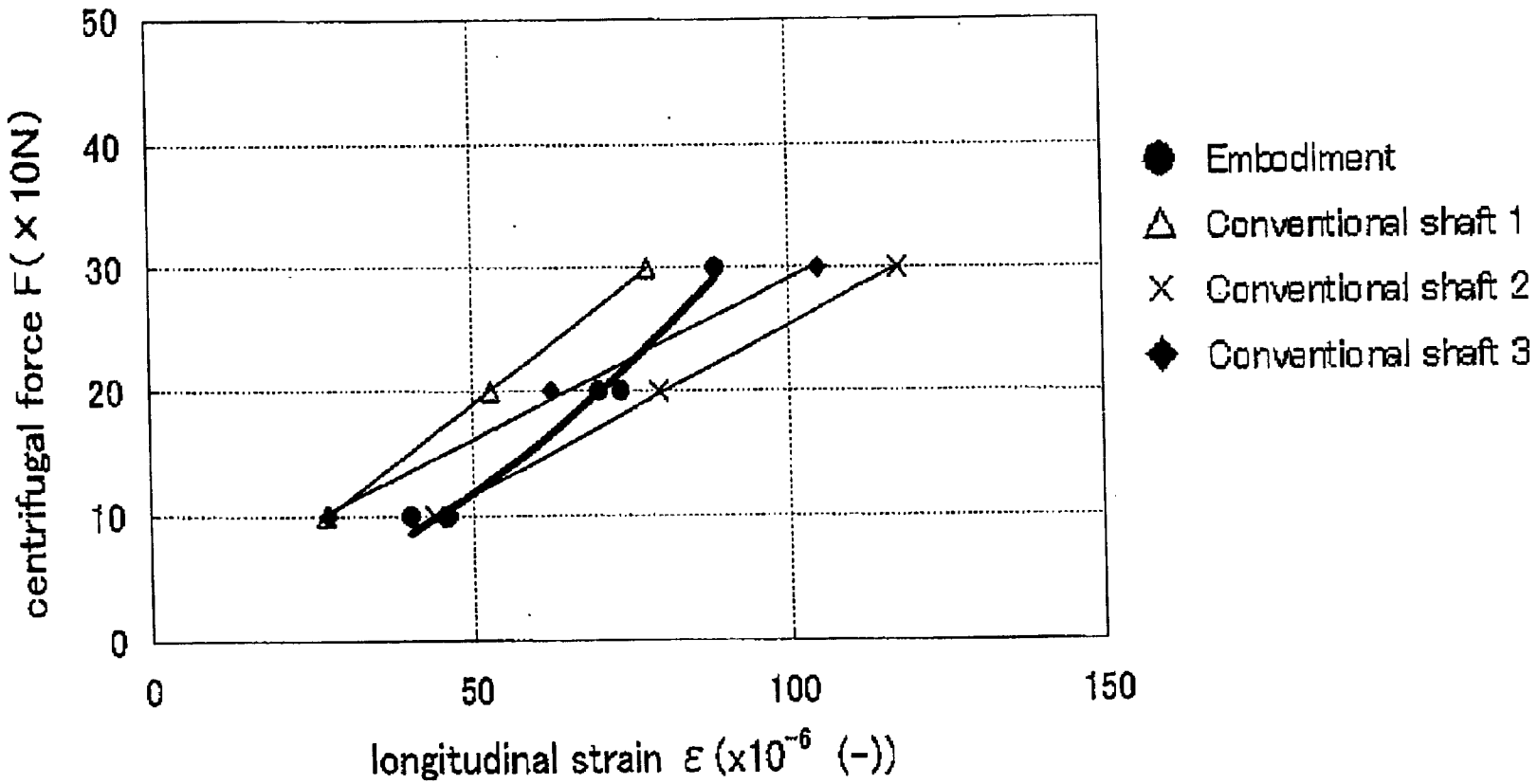
FIG. 5 is a graph showing the relationship between the longitudinal strain $\epsilon x$ (axis of abscissa) of the shaft at the position 700 mm from the tip end and the centrifugal force F (axis of ordinate).
Figure 6:
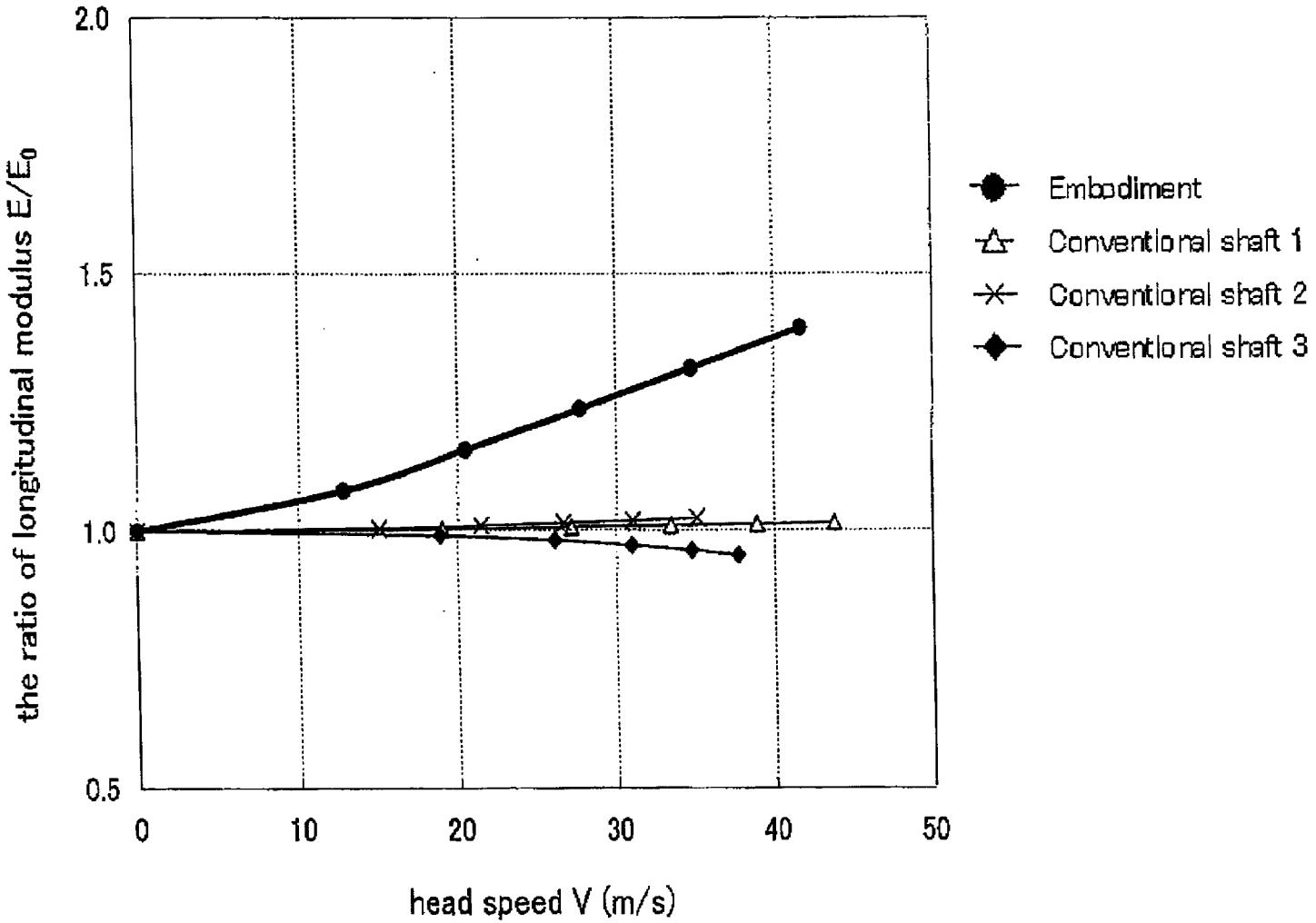
FIG. 6 is a graph showing the relationship between the head speed V (axis of abscissa) (calculated for M=0.2 (kg) and L=1 m) and the ratio (axis of ordinate) of the longitudinal modulus E at the different head speed V against the longitudinal modulus $E_0$ (when the head speed V is zero).

The embodiments of the above description and conventional shafts are now described below. The golf club was placed with its butt end 4 upward and the tip end 3 downward as shown in FIG. 1, and a weight was suspended from the tip and of the shaft in accordance with the preferred embodiment and the shafts of commercially available golf clubs. Then static tensile load F corresponding to the centrifugal force was applied. The longitudinal strain $\epsilon x$ (or tensile strain) at the position 700 mm from the shaft tip end 3 was measured using a commercially available biaxial orthogonal strain gauge (manufactured by Kyowa Electronic Instruments Co., Ltd.) to examine the relationship between the longitudinal strain $\epsilon x$ and the centrifugal force F (FIG. 5). The strain gauge was attached to the shaft in the circumferential direction of the shaft so that it is positioned orthogonal to the longitudinal axis. The applied loads F included 100 N, 200 N, and 300 N. The relationship between the head speed V and the longitudinal modulus E was also examined (FIG. 6).

A strain gauge (manufactured by Kyowa Electric Industries) was also utilized to measure lateral strain (or compressive strain) $\epsilon yz$, and the Poisson's ratios $\nu$ shown in Table were also obtained based on the longitudinal strain $\epsilon x$ and lateral strain $\epsilon yz$.

The materials of the shafts measured are described below.

Shafts of Commercially Available Golf Clubs

Conventional shaft 1: Metal shaft for the iron. The metal material used is chrome molybdenum steel, which is isotropic material, with the shaft weight of approximately 120 g.

Conventional shaft 2: FRP S/R shafts for the iron.

Conventional shaft 3: FRP FW shaft for the wood. The shaft weight was approximately 100 g.

Shafts in Accordance with the Present Invention

Embodiment: FRP braided shaft for the wood. The shaft comprises two first inner layers in which sets of eight diagonal yarns in two directions are woven at the orientation angle of +38 to +50° and −38 to −50°, respectively from the tip end of to the butt end (1143 mm from the tip end) of the shaft; one second inner layer in which sets of eight diagonal yarns in two directions are braided at the orientation angle of +41° to +55° and −41° to −55° respectively from the tip end of to the butt end (1143 mm from the tip end) of the shaft over the first inner layers; and one outer layer in which sets of eight diagonal yarns in two directions and sets of eight warps are braided over the inner layer at the orientation angle of +7° to +19° and −7° to −19° for the former and 0° for the latter from the tip end of to the butt end. The longitudinal modulus E of the carbon fibers of the first and second inner layers is 460 GPa, and the longitudinal modulus E of the outer layer is 240 GPa. The thickness of the first and second inner layers accounts for approximately 75% of the entire thickness. The average yarn width t of the warps and two-directional diagonal yarns is 2.0 mm. The weight of the shaft is approximately 100 g.

FIG. 5 shows the relationship between the longitudinal strain $\epsilon x$ (axis of abscissa) at the position 700 mm from the tip end and the centrifugal force F (axis of ordinate). The figure reveals that the longitudinal strain $\epsilon x$ linearly increases with an increase in the centrifugal force F in the conventional shafts 1 through 3 while the centrifugal force F and longitudinal strain $\epsilon x$ are not in linear relationship in the embodiment of the present invention. It is also revealed that the shaft of the present embodiment is difficult to deform when compared with the conventional shafts even when the centrifugal force F increases.

This advantage of the embodiment is assumed to attribute to the fact that the shaft includes braid layers satisfying the equation (2) and a braid layer satisfying the equation (4). More specifically, the first inner layer satisfies the equation (2) within the range between 0 and 520 mm from the shaft tip end, the second inner layer satisfies the equation (2) within the range between 0 and 420 mm from the shaft tip end, and the outer layer satisfies the equation (4) within the range between 340 and 1143 mm from the shaft tip end.

The centrifugal force F may be expressed by the equation $$F=M\times V^2/L$$

where V is the head speed immediately before the impact, M is the weight of the head, and L is the length of the club. The equation may be transformed to $$V=\{(F\times L/M)^{1/2}.$$

When M=0.2 (kg) and L=1 m are assigned, the head speed V may be obtained based on the centrifugal force F.

The centrifugal force per unit longitudinal strain $F/\epsilon x$, which is inclination of the graph in FIG. 5, may be converted to the longitudinal modulus E. As shown in FIG. 6, the head speed V (with M=0.2 (kg) and L=1 m) is shown as the axis of abscissa, and the ratio of the longitudinal modulus E at the different head speed against the longitudinal modulus $E_0$ (when the head speed V is zero) is shown as the axis of ordinate to form a graph. The graph shows that the longitudinal modulus E is maintained almost constant even with increases in the head speed in the shafts of the conventional shafts 1 through 3, but that the longitudinal modulus E of the shaft of the present invention gradually increases. In particular, the longitudinal modulus E of the shaft of the present invention reaches about 1.2 times that at zero head speed when the head speed is about 30 m/s and reaches about 1.4 times that at zero head speed when the heat speed is about 40 m/s. For females and seniors, the head speed of the golf club may reach about 20 to 35 m/s just before the impact. For males and professional golfers, the head speed of the golf club may reach about 35 to 50 m/s just before the impact. The rigidity of the shaft of the present invention increases as the speed increases until the impact. With these characteristics, it was indicated that the shaft of the present invention deviated less from the swing plane during the swing due to deflection of the shaft. It suggested that the shaft of the present invention may be used with reliable stability.

Table 1 shows the measurement results of the Poisson's ratios ν when the centrifugal force F was applied to the shafts tested.

TABLE 1

Poisson's ratios ν of conventional shafts and a shaft in accordance with the present invention

| Distance from tip (mm) | Conventional shaft 1 | Conventional shaft 2 | Conventional shaft 3 | Embodiment |
|---|---|---|---|---|
| 700 | 0.31 | 0.76 | 0.55 | 0.45 |

While the metal shaft of the conventional shaft 1 showed low Poisson's ratios ν of approximately 0.3 at the position 700 mm from the tip end, the FRP shafts to conventional shafts 2 and 3 showed Poisson's ratios ν higher than 0.5. The shaft of the present invention showed a Poisson's ratio ν below 0.5, even though it is made of FRP.

Professional male golfers, who have used clubs with the shaft of the same material as the conventional shaft 1 so far, tried the wood club that include the shafts of the conventional shafts 1 and 3 and of the embodiment. As a result, the club with the shaft of the embodiment, which is lighter by 20 g than the conventional shaft 1, was evaluated as being stable for a long flying distance. The shaft of the conventional shaft 3 having the same shaft weight as the embodiment was evaluated as being unstable during a swing and causing misfit feelings.

It should be apparent to those skilled in the art that the present invention may be embodied in many other specific forms without departing from the spirit or scope of the invention. Particularly, it should be understood that the invention may be embodied in the following forms.

Although the degrees of orientation +θ and −θ of the diagonal yarns 11 and 12 of the braid layer 21 preferably range from +30° to +60° and −30° to −60° substantially throughout the longitudinal length of shaft 2, respectively, and more preferably from +35° to +55° and −35° to −55° respectively, it would be satisfactory so long as the diagonal yarns 11 and 12 come within the degrees of orientation at a part of the longitudinal length of the shaft 2. Although the degrees of orientation +θ and −θ of the diagonal yarns 11 and 12 of the braid layer 22 preferably range from +15° to +40° and −15° to −40° substantially throughout the longitudinal length of shaft 2, respectively, and more preferably from +15° to +35° and −15° to −35°, respectively, it would be similarly satisfactory so long as the diagonal yarns 11 and 12 come within the degrees of orientation at a part of the longitudinal length of the shaft 2.

The portions of the braid layers 21 and 22 satisfying the equations (2) and (4) may be at least a portion in the longitudinal direction of the shaft.

Although the average width t (mm) of the braid yarns 10, 11, and 12 is 1.6 to 2.4 in the above embodiment, it may take any value so long as it is suitable to constitute the braid layers.

Although the standard deviation σt the width of the diagonal yarns 11 and 12 is set as approximately 20%, the standard deviation σt is only required to come within the range obtained in calculation of the average width t.

The shaft may have one or both of the braid layers 21 and 22, and the number of the braid layers may be singular or plural. When a plurality of braid layers and 21 and 22 are provided, the average width t (mm) of the warps 10 and diagonal yarns 11 and 12 may be the same or different for each layer. The number of the warps 10 and diagonal yarns 11 and 12 may be same or different for each layer.

Figure 7:
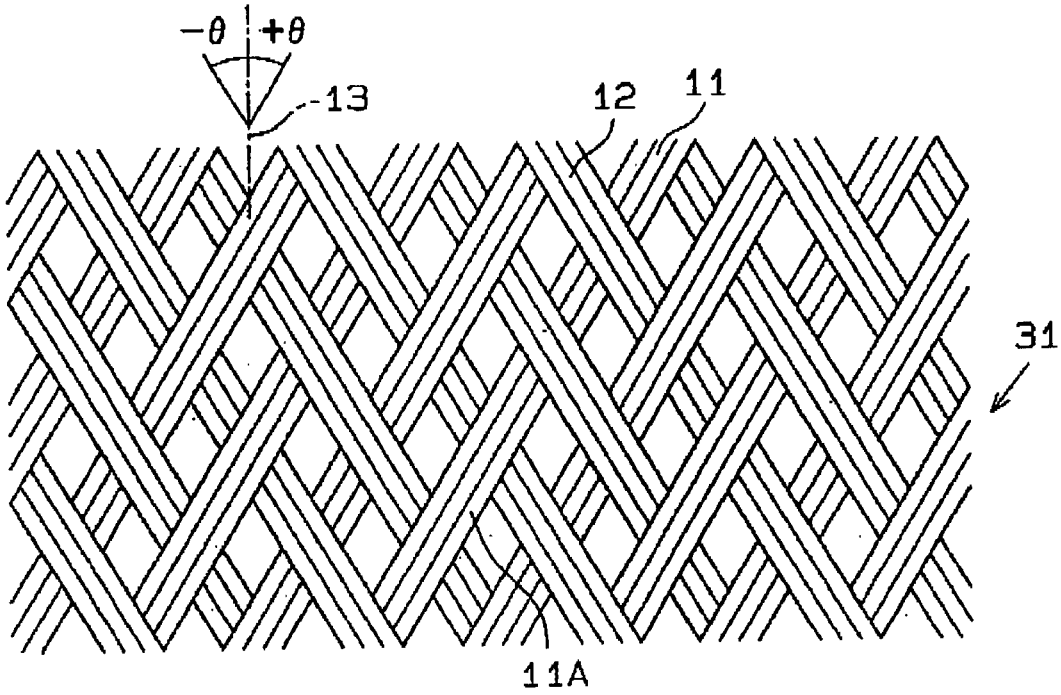
FIG. 7 is a partially enlarged view showing a part of another embodiment of biaxial braid layer of a preferred shaft in accordance with the present invention.
Figure 8:
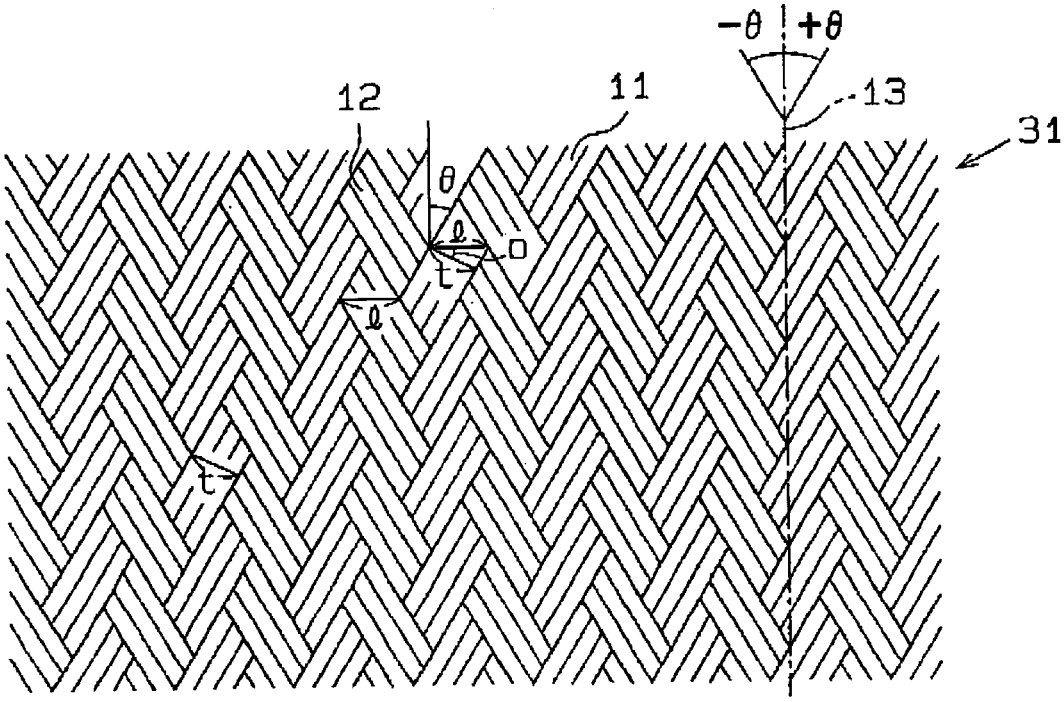
FIG. 8 is a partially enlarged view showing a part of an embodiment of biaxial braid layer of most preferred shaft in accordance with the present invention in which gaps between the yarns are further narrowed from the braid layer of FIG. 7.

The braid layer 21 having biaxial construction shown in FIGS. 2 and 3 may be replaced by a braid layer 31 having biaxial construction as shown in FIGS. 7 and 8. In FIG. 7, the braid layer 31 has the same degrees of orientation of the diagonal yarns 11 and 12 in the braid layer 31 as in FIG. 2, and the diagonal yarns 11A and 12A intersect with each other in a pattern such that they pass above, above, below, below, above, above, below, below, and so forth with relative to other diagonal yarns. The embodiment where the gaps between the yarns are further narrowed from the braid layer 31 of the embodiment in FIG. 7 is shown in FIG. 8, which, like FIG. 3, satisfies the equation (2).

Figure 9:
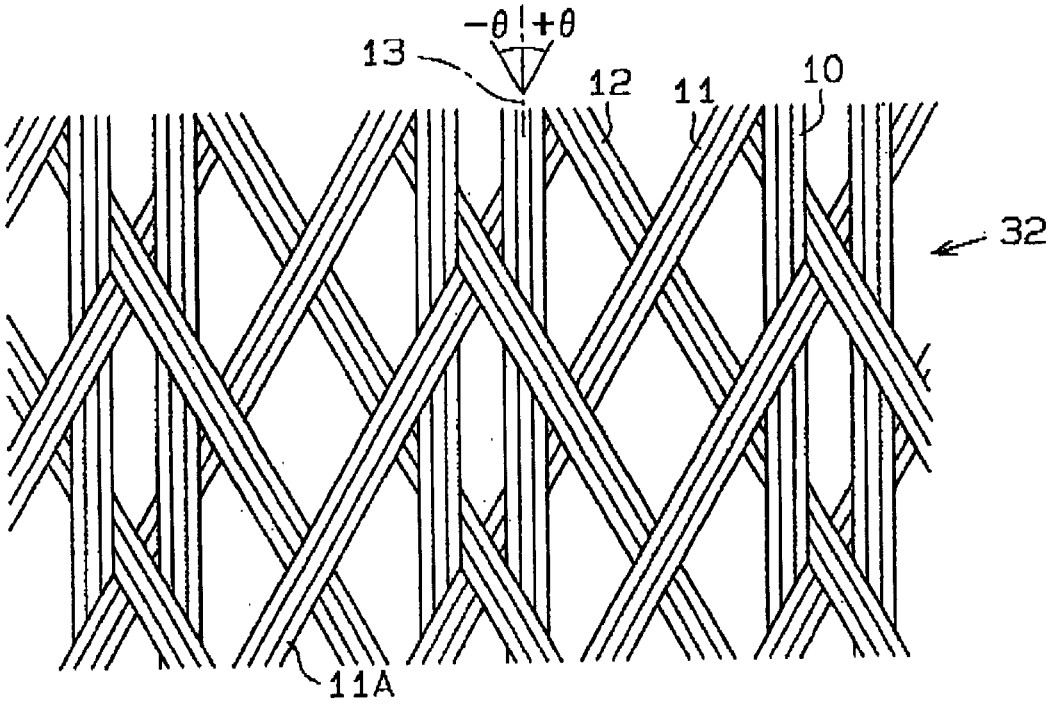
FIG. 9 is a partially enlarged view showing a part of another embodiment of triaxial braid layer of a preferred shaft in accordance with the present invention.
Figure 10:
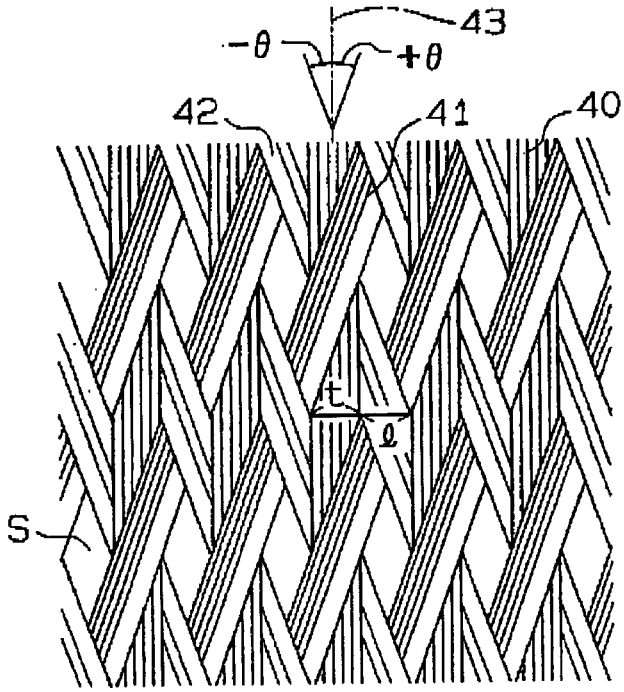
FIG. 10 is a partial enlarged view showing a part of the braid layer of the conventional shaft.

The braid layer 22 having triaxial construction in FIG. 4 may be replaced by a braid layer 32 having triaxial construction as shown in FIG. 9. In FIG. 9, the braid layer 32 has the same degrees of orientation of the warps 10 and the diagonal yarns 11 and 12 in the braid layer 32 as in FIG. 4, and the diagonal yarn 11 intersects with the warps 10 and diagonal yarn 12 such that the yarn 11 passes below, below, below, above, above, above, below, below, below and so forth with relative to the warps 10 and diagonal yarn 12 from the top to the bottom of the figure. The diagonal yarns 12 intersect with the warps 10 and diagonal yarns 11 in a pattern such that they pass above, above, above, below, below, below, above, above, above, and so forth with relative to the warps 10 and diagonal yarns 11 from the top to the bottom of the figure.

In the braid layers 21, 22, 31, and 32 shown in FIGS. 2 through 4 and 7 through 9, the vertical intersection position of the diagonal yarns 11 and 12 may be reversed. The diagonal yarns 11 in FIG. 4 may be set in a pattern, below, below, above, below, below, above, and so forth, and the diagonal yarns 12 in a pattern above, above, below, above, above, below, and so forth, although not shown in the figure.

The shaft may include inner layers of the braid layers 21, 31 and an outer layer of the braid layers 22, 32 whose longitudinal modulus is smaller than that of the inner layer.

The longitudinal modulus E of the shaft when the head speed is about 30 m/s is preferably at least about 1.2 times that when the head speed is zero.

Therefore, the present examples and embodiments are to be considered as illustrative and not restrictive and the invention is not to be limited to the details given herein, but may be modified within the scope and equivalence of the appended claims.

What is claimed is:

1. A golf club shaft made of fiber reinforced plastics having a braid layer along the length of the shaft that includes first diagonal yarns having a first orientation angle against the longitudinal axis of the shaft and second diagonal yarns having a second orientation angle, which is symmetrical with the first orientation angle, against the longitudinal axis of the shaft as the center axis, wherein the ratio of the longitudinal modulus of the shaft during a swing to the longitudinal modulus of the shaft when the head speed is zero increases with the increase in the head speed, wherein the longitudinal modulus of the shaft at the head speed of about 30 m/s is at least 1.2 times the longitudinal modulus of the shaft when the head speed is zero.

2. A golf club shaft made of fiber reinforced plastics having a braid layer along the length of the shaft that includes first diagonal yarns having a first orientation angle against the longitudinal axis of the shaft and second diagonal yarns having a second orientation angle, which is symmetrical with the first orientation angle, against the longitudinal axis of the shaft as the center axis, wherein the ratio of the longitudinal modulus of the shaft during a swing to the longitudinal modulus of the shaft when the head speed is zero increases with the increase in the head speed, wherein the braid layer includes a portion satisfying an inequality:

$$n\cdot\{(t-\sigma t)/\cos\theta\}\leqq\pi\cdot D\leqq n\cdot\{(t+\sigma t)/\cos\theta\}$$

where θ is the orientation angle, t is the average width of the first and second diagonal yarns, σt is the standard deviation, D is the shaft diameter, and n is the number of diagonal yarns.

3. A golf club shaft according to claim 2, wherein the first and second degrees of orientation are +30° to +60° and −30° to −60° respectively.

4. A golf club shaft according to claim 2, wherein the first and second degrees of orientation (θ, −θ) are +15° to +40° and −15° to −40° respectively.

5. A golf club shaft according to claim 2, wherein the portion of the braid layer further satisfies the equation $\pi D=n\cdot t/\cos\theta$.

6. A golf club shaft according to claim 2, wherein the portion of the braid layer satisfying the inequality includes one third from the tip end of the shaft.

7. A golf club shaft according to claim 2, wherein the shaft include inner layers of the braid layer and an outer layer of the braid layer, wherein the longitudinal modulus of the inner layer is greater than that of the outer layer, and wherein the thickness of the inner layers is half or more of the entire thickness of the shaft.

8. A golf club shaft according to claim 2, wherein the thickness of the braid layer in the radial direction is two third or more of the entire thickness of the shaft in the radial direction.

9. A golf club shaft according to claim 2, wherein the longitudinal modulus of the shaft at the head speed of about 30 m/s is at least about 1.2 times the longitudinal modulus of the shaft when the head speed is zero.

10. A golf club shaft made of fiber reinforced plastics having a braid layer along the length of the shaft that includes first diagonal yarns having a first orientation angle against the longitudinal axis of the shaft and second diagonal yarns having a second orientation angle, which is symmetrical with the first orientation angle, against the longitudinal axis of the shaft as the center axis, wherein the ratio of the longitudinal modulus of the shaft during a swing to the longitudinal modulus of the shaft when the head speed is zero increases with the increase in the head speed, wherein the braid layer further comprises warps positioned at the orientation angle of approximately 0, wherein the braid layer includes a portion satisfying an inequality:

$$n\cdot(t+t/\cos\theta)<\pi\cdot D\leqq 2n\cdot(t+t/\cos\theta)$$

where θ is the orientation angle, t is the average width of the first and second diagonal yarns and warps, D is the shaft diameter, n is the number of diagonal yarns, and n is also the number of the warps.

11. A golf club shaft according to claim 10, wherein the average width t comes within the range between t−σt and t+σt where σt is the standard deviation of the widths of the warps and first and second diagonal yarns.

12. A golf club shaft according to claim 10, wherein the portion of the braid layer satisfying the inequality includes two third from the butt end of the shaft.

13. A golf club shaft according to claim 10, wherein the longitudinal modulus of the shaft at the head speed of about 30 m/s is at least about 1.2 times the longitudinal modulus of the shaft when the head speed is zero.

14. A golf club shaft according to claim 10, wherein the first and second degrees of orientation (θ, −θ) are +15° to +40° and −15° to −40° respectively.

15. A golf club shaft made of fiber reinforced plastics having a braid layer along the length of the shaft that includes first diagonal yarns having a first orientation angle against the longitudinal axis of the shaft and second diagonal yarns having a second orientation angle, which is symmetrical with the first orientation angle, against the longitudinal axis of the shaft as the center axis, wherein the ratio of the longitudinal modulus of the shaft during a swing to the longitudinal modulus of the shaft when the head speed is zero increases with the increase in the head speed, wherein the Poisson's ratio expressed by the longitudinal and lateral strains is 0.5 or less at least at a part of the shaft, wherein the longitudinal strain of the shaft is the strain in the longitudinal direction of the shaft and the lateral strain is the strain in the circumferential direction of the shaft when load is applied to the shaft.

16. A golf club shaft according to claim 15, wherein the Poisson's ratio is 0.3 or more at said part.

17. A golf club shaft according to claim 15, wherein the part having the Poisson's ratio of 0.5 or less includes one third of the shaft length from the vicinity of the butt end of the shaft toward the tip end of the shaft.

18. A golf club shaft according to claim 15, wherein the part having the Poisson's ratio of 0.5 or less includes a portion the external diameter of which is greater than a half of the sum of the external diameter of the shaft tip end and that of the shaft butt end.

19. A golf club shaft made of fiber reinforced plastics having a braid layer along the length of the shaft that includes first diagonal yarns having a first orientation angle against the longitudinal axis of the shaft and second diagonal yarns having a second orientation angle, which is symmetrical with the first orientation angle, against the longitudinal axis of the shaft as the center axis, wherein the ratio of the longitudinal modulus of the shaft during a swing to the longitudinal modulus of the shaft when the head speed is zero increases with the increase in the head speed, wherein the shaft comprises a plurality of the braid layers, wherein each of the braid layers includes an inner layer having first and second diagonal yarns, wherein the inner layer has a portion satisfying an inequality:

$$n\cdot\{(t-\sigma t)/\cos\theta\}\leqq\pi\cdot D\leqq n\cdot\}(t+\sigma t)/\cos\theta$$

where θ is the orientation angle of the first and second diagonal yarns, t (t=1.6 through 2.4 (mm)) is the average width of the first and second diagonal yarns, σt (σt/t= approximately 20%) is the standard deviation of the width of the diagonal yarns, D ((3.0 mm≦D≦16.0 mm)) is the shaft diameter, and n (n=2, 4, 8, 16 . . . $2^k$, where k is a positive integer) is the number of diagonal yarns, and an outer layer positioned over the inner layer having third and fourth diagonal yarns, which are symmetrical with each other at third and fourth orientation angles against the longitudinal axis of the shaft, and warps, wherein the outer layer has a portion satisfying an inequality:

$$n'\cdot(t'+t'/\cos\theta)<\pi\cdot D'\leqq 2n'\cdot(t'+t'/\cos\theta)$$

where θ is the orientation angle of the third and second diagonal yarns, t' (t'=1.6 through 2.4 (mm)) is the average width of the third and fourth diagonal yarns, D' ((3.0 mm≦D'≦16.0 mm)) is the shaft diameter, n' is the number of the third and fourth diagonal yarns, and n' (n'=2, 4, 8, 16 . . . $2^k$, where k is a positive integer) is also the number of the warps.

* * * * *

Disclaimer

6,666,778 B2 — Hiroki Ashida, Gifu, Japan. FRP GOLF CLUB SHAFT. Patent dated Dec. 23, 2003. Disclaimer filed January 27, 2005, by the assignee, Mizuno Corporation.

The term of this patent, subsequent to the term of patent number 6,572,490 B2 has been disclaimed.

*(Official Gazette May 17, 2005)*